United States Patent [19]

Elliott

[11] Patent Number: 4,580,686

[45] Date of Patent: Apr. 8, 1986

[54] SLACKLESS SELF-ADJUSTING ROTARY DRAWBAR FOR RAILROAD CARS

[75] Inventor: William O. Elliott, Pittsburgh, Pa.

[73] Assignee: McConway & Torley Corporation, Pittsburgh, Pa.

[21] Appl. No.: 653,500

[22] Filed: Sep. 21, 1984

[51] Int. Cl.[4] ..... B61G 5/02

[52] U.S. Cl. ..... 213/62 A; 105/3; 213/97; 213/184

[58] Field of Search ..... 105/3, 4 R; 213/62 R, 213/62 A, 75 R, 85, 96, 97, 182, 183, 184

[56] References Cited

U.S. PATENT DOCUMENTS

| | | | |
|---|---|---|---|
| 1,549,815 | 8/1925 | Tomlinson | 213/184 |
| 1,925,319 | 9/1933 | Goodall | 213/62 A |
| 2,282,146 | 5/1942 | Mealing et al. | 213/62 A |
| 2,327,240 | 8/1943 | Barrows et al. | 213/62 A |
| 3,709,376 | 1/1973 | Altherr | 213/62 R |
| 3,716,146 | 2/1973 | Altherr | 213/75 R |
| 4,258,628 | 3/1981 | Altherr | 105/4 R |

FOREIGN PATENT DOCUMENTS

| | | | |
|---|---|---|---|
| 350383 | 3/1922 | Fed. Rep. of Germany | 213/183 |
| 87594 | 10/1936 | Fed. Rep. of Germany | 213/62 A |

*Primary Examiner*—Robert B. Reeves
*Assistant Examiner*—David F. Hubbuch
*Attorney, Agent, or Firm*—Thomas H. Murray; Clifford A. Poff

[57] ABSTRACT

A slackless drawbar arrangement for unit train service and the like including a drawbar having enlarged butt end portions each provided with essentially spherical buff and draft load bearing surfaces on the rear and forward surfaces thereof. The enlarged butt end portions are supported by a front draft block and a rear buff block within a center sill. The front draft block is supported against a curved surface of a wear block which is, in turn, supported by keys welded to the sill. The rear buff block is supported against a gravity-activated wedge which is, in turn, supported by rear draft lugs welded to the center sill. A bottom plate retains the various blocks inside the cavity of the center sill.

12 Claims, 10 Drawing Figures

SLACKLESS SELF-ADJUSTING ROTARY DRAWBAR FOR RAILROAD CARS

BACKGROUND OF THE INVENTION

This invention relates to a drawbar connecting together railroad cars, and more particularly to a drawbar arrangement embodying a simplified construction and arrangement of parts that includes a drawbar with a convex spherical end contained between a front draft block support against a wear block by a center sill and a rear support block supported against a gravity-fed wedge by the center sill.

As is known, most prior art railroad coupler assemblies are relatively complicated and include a draft sill, draft gear, yoke, follower block, striker, pin or coupler connection and the coupler itself and its associated components. Such conventional coupler arrangements have a degree of free and cushioned slack. That is, there is a certain amount of free "play" between the coupler components when the load changes from a draft to a buff load, and vice versa. At the same time, the draft gear acts as a spring mechanism to cushion impacts between adjacent cars. Research has indicated that eliminating the free and cushioned slack within a train can eliminate over the road train action forces due to "run-ins" and "run-outs". The magnitudes of these forces are large and cause significant wear and tear on the rolling stock and in some instances are severe enough to cause derailments.

Furthermore, in conventional coupler assemblies, the key or pin connection of the coupler to the yoke is at a relatively long distance from the kingpin about which the wheel truck rotates. In negotiating curves, particularly under buff loading conditions, this gives rise to relatively large lateral forces which can cause derailments. The same is true when jackknifing occurs under buff loads with lateral forces attempting to rotate the cars about their centers.

SUMMARY OF THE INVENTION

While not limited thereto, the present invention is particularly adapted for use in unit train applications where cars are coupled and uncoupled for periodic maintenance and repair only. Such cars are not subjected daily to impact forces associated with humping encountered in classification yards and, therefore, do not require cushioning devices such as draft gears.

Specifically, there is provided a drawbar arrangement for coupling railroad cars each having a center sill and trucks at its opposite ends, the trucks being pivotal about vertical kingpins. The arrangement includes a drawbar having an enlarged spherical butt end portion defining essentially convex spherical buff and draft load bearing surfaces, a shank of the drawbar projecting from the convex spherical draft load surface, a rear support block having a tapered rear surface and a concave substantially hemispherical buff load bearing surface adapted to engage with the convex buff load bearing surface of the butt portion, a slack adjusting wedge for engaging the tapered surface of the rear support block, means for transferring buff loads from the slack adjusting wedge to the center sill, a front draft block having a concave and substantially hemispherical draft load surface adapted to engage with the convex draft load surface of the enlarged spherical butt end portion, the front draft block including an annular draft load surface opposite the hemispherical draft load surface thereof, a wear block having an annular draft load surface adapted to engage the annular draft load surface of the front draft block, and means supported by the center sill for transferring a draft load from the wear block to the center sill.

Preferably, the drawbar arrangement of the present invention provides that the draft block and the wear block each has an opening wherein the shank of the drawbar extends in a direction which is generally opposite the kingpin. The aforesaid means supported by the center sill includes a plurality of draft stop lugs supported by the center sill. A sill bottom plate is preferably secured to the center sill for supporting one of the plurality of draft stop lugs. The center sill includes spaced-apart sill side walls extending along opposite sides of a sill roof wall. The drawbar arrangement preferably further includes a carrier plate supported by the center sill opposite the roof wall thereof for supporting the rear support block, front draft block and the wear block between the side walls of the center sill. The tapered surface of the slack adjusting wedge is preferably arranged to extend in a vertical direction along the height of the side walls of the outer sill. The tapered thickness of the wedge is greater at the top thereof than at the bottom for movement under the force of gravity between the rear support block and the lugs supporting the wedge on the center sill. An opening in the front draft block is preferably longer in the vertical direction than in the horizontal direction, whereby the draft front block will rotate with the drawbar shank portion in a horizontal plane but not in a vertical plane. Moreover, the rear support block and front draft block can rotate in an endless manner about an axis extending substantially along a central longitudinal axis of the shank relative to the convex spherical buff and draft load surfaces. This pivotal action at the end connections facilitates rotation, and permits 360° rotation for negation of horizontal and vertical track curves as well as rotary car dumping.

With an arrangement of this sort, free and cushioned slack are eliminated from the interconnection between cars, thus eliminating undesirable longitudinal train action forces and reducing the risk of derailment. The slackless connection between cars provided by the present invention eliminates run-in and run-out of slack between cars in reversals of draft and buff train actions. This also eliminates the generation of large forces due to relative accelerations between cars, thus reducing wear and damage to car components, lading and locomotives, thereby reducing maintenance cost. The design of the drawbar according to the present invention reduces an estimated 650 pounds from the tear weight of the car and eliminates couplers, yokes, cushioning devices and strikers. At the same time, the structure forming the pivotal connection at each end of the drawbar can be incorporated into existing center sills without modification of the center sills. Moreover, the site at which the structure used to interconnect the end of the drawbar with the center sill can be located at any desired location but preferably rearwardly of the car to reduce lateral wheel force components. By moving the pivot point of the drawbar toward the center line of the bolster, car tracking through tight radius curves is enhanced while reducing the potential for track overturn plus wheel wear. The present invention further utilizes a gravity-activated wedge which is arranged to move vertically to compensate for wear and maintain a slackless relationship of parts that interconnect the drawbar with the car. The simplified design of the drawbar of the present invention permits the construction of parts that are inherently less likely to fail and provide greater reliability at reduced operating costs.

The above and other objects and features of the invention will become apparent from the following detailed description taken in connection with the accompanying drawings which form a part of this specification, and in which.

Figure 1:
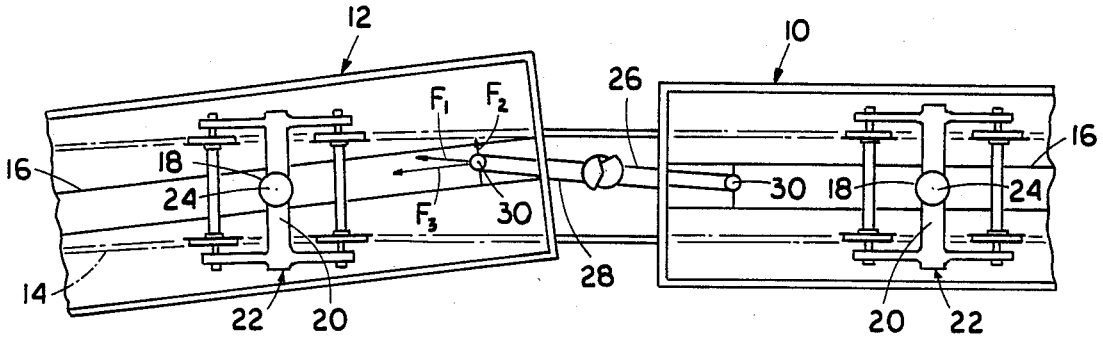
FIG. 1 is a schematic illustration of a prior art railroad coupler arrangement showing the lateral forces which result under buff loads during negotiation of a curve.

With reference now to the drawings, and particularly to FIG. 1, there is shown adjacent railway cars 10 and 12, the car 12 being on a curved track section 14. Each car 10 and 12 includes a center sill 16 having a center plate 18 which rests on the bolster 20 of a wheel truck 22. Extending through the center plate 18 is a kingpin, not shown, whose axis is indicated generally by the reference numeral 24 and about which the truck 22 can pivot in a horizontal plane. Interconnecting the two cars 10 and 12 are conventional couplers 26 and 28 which conventionally include a draft gear, a yoke, a follower block, and a pin or key coupler connection, the axis of the pin being indicated by the reference numeral 30. Each coupler can rotate in a horizontal plane about its associated pin connection 30.

With the cars 10 and 12 under a buff load with car 10 pushing the car 12, forces are imparted to the couplers 26 and 28. As can be seen in FIG. 1, the longitudinal force $F_1$ on the couplers is broken into a lateral force $F_2$ and a force $F_3$ which extends along the axis of the car. The lateral force $F_2$ exerts a sideways force on the truck 22 which is taken by the wheel flanges. The force $F_2$ also produces a moment about the kingpin 18 tending to twist the car about its center point. This lateral force produces relatively severe stresses on the car and in some cases can cause a derailment.

Figure 2:
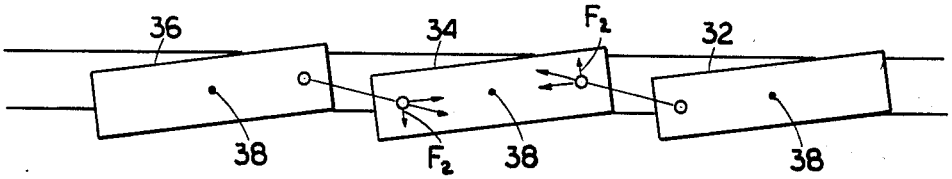
FIG. 2 illustrates jackknifing motions and resultant forces exerted on railroad cars during buff loads.

In FIG. 2, a condition is illustrated wherein three cars 32, 34 and 36 are undergoing jackknifing motions under a buff load. Again, lateral foces $F_2$ are exerted on the cars at the connection of couplers 26 and 28 thereto, these forces tending to twist the cars about their center points or centers of gravity.

Figure 3:
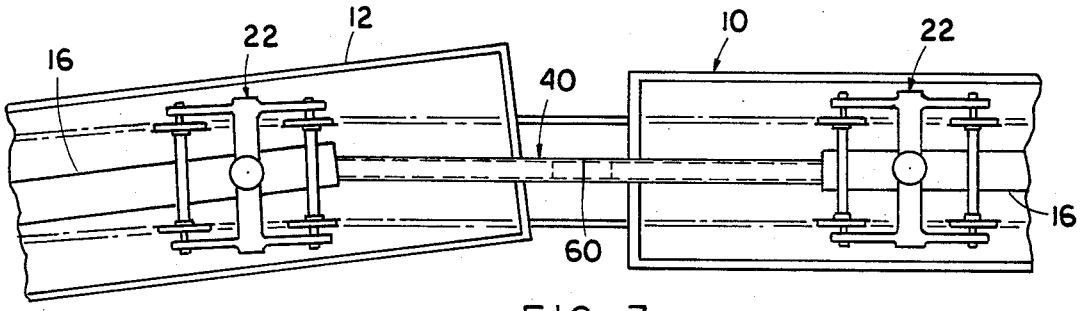
FIG. 3 is a schematic illustration of the drawbar arrangement of the invention.
Figure 4:
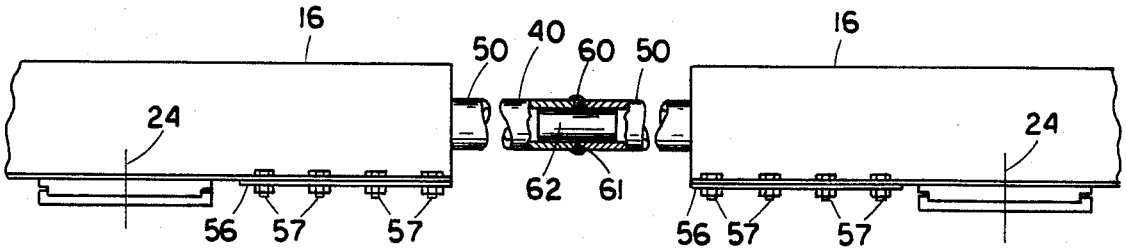
FIG. 4 is a side view of the drawbar coupler arrangement of the invention.

The arrangement of the present invention is shown in FIGS. 3 and 4 wherein the couplers 26 and 28 of FIG. 1 are replaced by a drawbar 40 which is pivotally connected at the ends of center sills 16. The center sills 16 are preferably reduced in length so that the ends of the drawbar 40 pivot about axes which are as close as possible to the center 24 of trucks for the car. As a result, the distance between the longitudinal axis of the drawbar and the central axis of each car 10 and 12 is much less, resulting in a lower wheel flange to rail force produced by force $F_2$. In addition, there is a reduced moment about the kingpin whose axes are indicated by the reference numeral 24.

Figure 7:
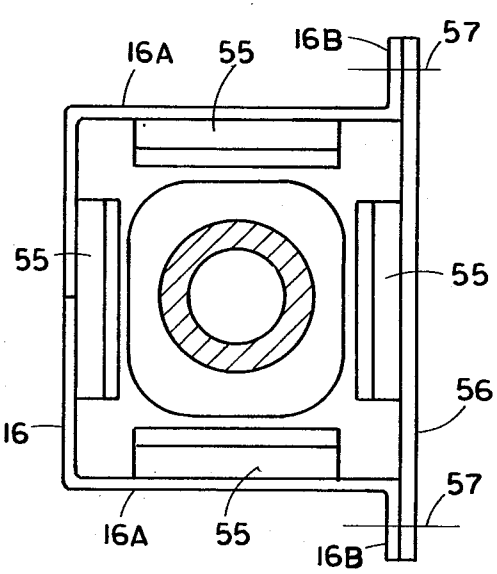
FIG. 7 is a front elevational view of the embodiment of the invention shown in FIG. 5.
Figure 5:
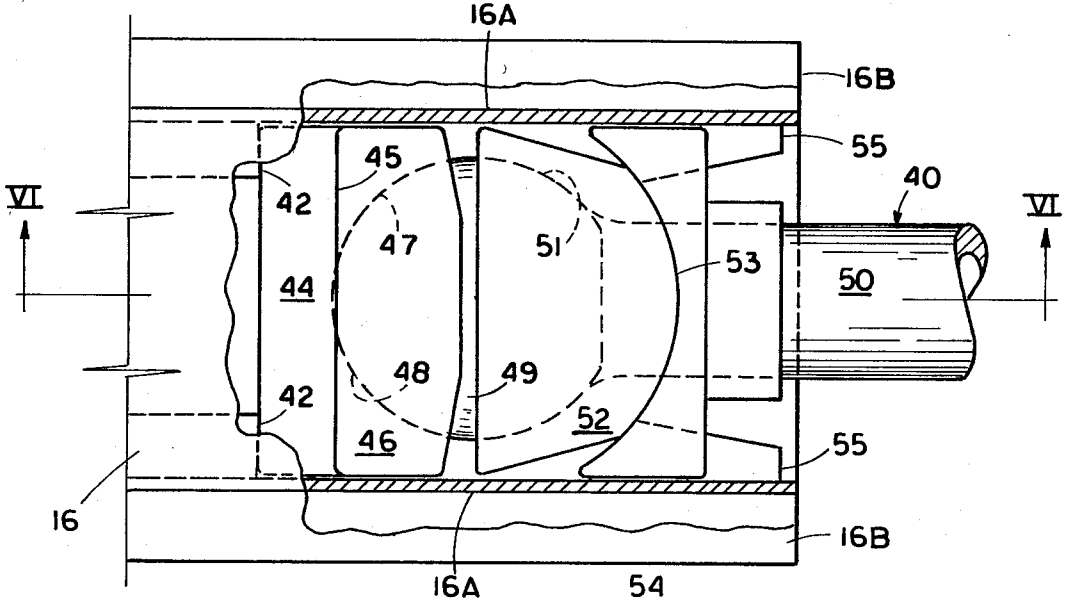
FIG. 5 is a plan view of one embodiment of the invention.
Figure 6:
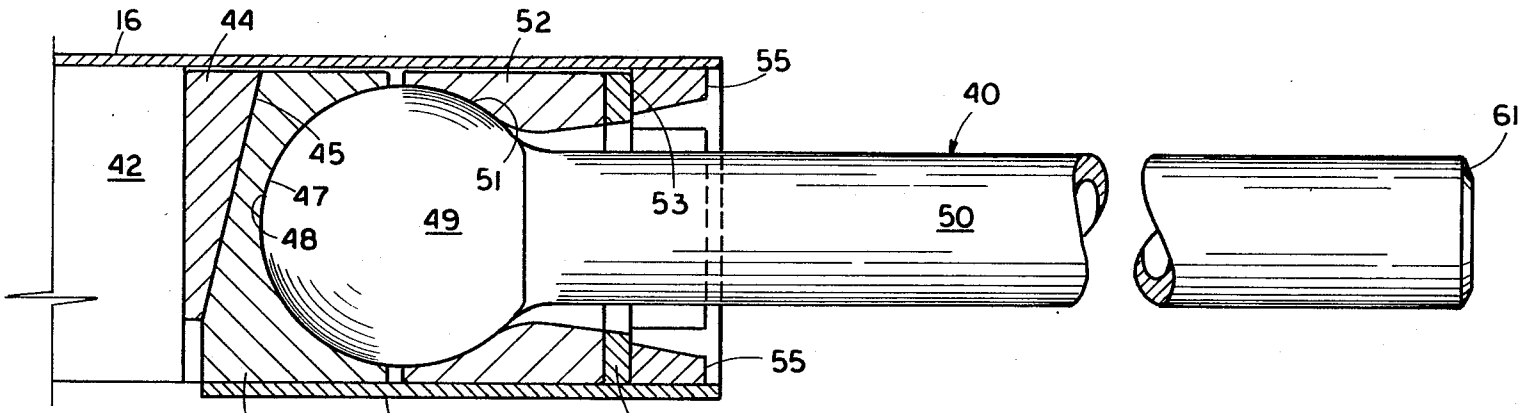
FIG. 6 is an elevational view, in section, taken along line VI—VI of FIG. 5.

With reference now to FIGS. 5–7, a specific embodiment of the invention is shown. The end portion of the center sill 16 is illustrated and takes the form of a conventional "Z" sill. Rear draft lugs 42 are secured as by welding to spaced-apart side walls 16A of the Z-sill. A flange 16B projects laterally from the lower edge of each side wall 16A. A slack adjusting wedge 44 is seated against the rear draft lugs for support thereby. The wedge has a vertically-tapered surface 45 in contact with a mating tapered surface on a rear support block 46. The wedge is arranged so that the force of gravity acting on the wedge exerts a continuous force against the rear support block 46. The tapered surface on the rear support block is at the rear thereof and opposite this surface is a concave, substantially hemispherical buff load bearing surface 47 adapted to engage with a convex buff load bearing surface 48 forming part of a spherical butt end portion 49 at the end of drawbar 40. A shank 50 projects from a convex spherical draft load bearing surface 51 that is seated against a hemispherical draft load surface formed in a front draft block 52. An annular draft load surface 53 faces a forward direction which is opposite the rearwardly-directed hemispherical draft load surface of the front draft block. As shown in FIG. 5, the annular draft load surface is curved between the side walls 16A of the center sill and engages with a mating annular draft load surface defined on a wear block 54. The front draft block 52 and wear block 54 are each provided with an opening through which shank 50 extends.

The draft load which is transferred to the wear block is distributed to the center sill by means which, in the embodiment shown in FIGS. 5–7, comprises a plurality of lugs 55. There are four lugs illustrated, one of which is welded to a top wall of the center sill to project downwardly into the space between the side walls 16A thereof and engages the forwardly-directed face of wear block 54. A second and third of the lugs 55 are welded to side walls 16A so that the lugs engage with the forwardly-directed face of the wear block. A fourth of the lugs is welded to a bottom cover plate 56, the latter being secured preferably by nut and bolt assemblies 57 to each of the flanges 16B. Thus, it can be seen that the lugs 55 extend from the side walls of the center sill and the bottom plate 56 into the space enclosed by the sill and the bottom plate. The faces of the lugs which are opposite each other are tapered so that the shank 50 of the drawbar can move back and forth in both the horizontal and vertical directions. The lugs efficiently transfer the pull forces from the drawbar by way of the front draft block 52 and wear block 54 to the center sill. Clearances between the rear support block 46 and the enlarged spherical butt end portion 49 are eliminated by the slack adjusting wedge 44 due to the continued force of gravity urging the wedge downwardly and thereby eliminating any clearances between the parts.

To transmit buff loads, the forces imposed on shank 50 are transferred by the rear support block 46 through the slack adjusting wedge 44 to the rear draft lugs 42 and thereby to the center sill. The tapering surface of the wedge is selected so that the wedge will not retreat vertically under the imposed forces, thereby consistently maintaining a metal-to-metal contact relationship between all of the parts situated between the rear draft lugs 42 and front draft lugs 55. Should it be necessary for the purpose of disassembling the drawbar to relieve the clamping force provided by the slack adjusting wedge 44, an instrument such as a pushbar (not shown) can be inserted at the rear edge of plate 56 into contact with the lower edge of the wedge to displace it vertically.

The drawbar 40 in the embodiment of FIGS. 3 and 4 is formed in two shank halves 50 interconnected by a weld joint 60 which comprises a suitable layer of weld metal applied to a groove formed by chamfered surfaces 61 on the projected ends of the shank halves. A shaft member 62 extends between at the end faces of the shank halves to maintain a coaxial aligned relation during the welding process. Other means for interconnecting the shank halves can be used, if desired.

Figure 8A:
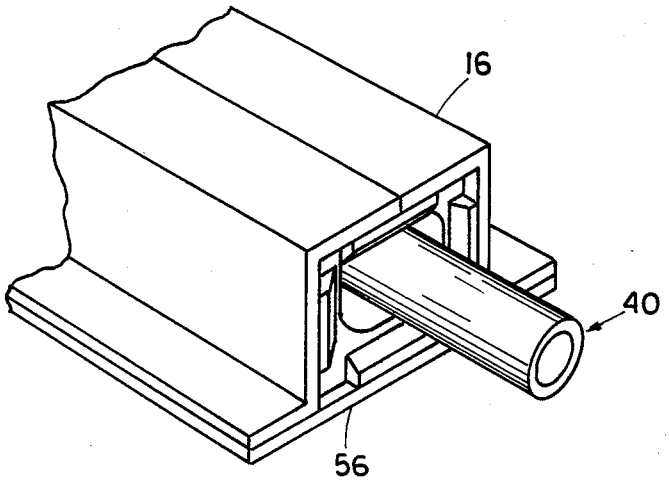
FIGS. 8A–8C are perspective views showing the various positions of the drawbar with respect to its support structure carried within the center sill.
Figure 8B:
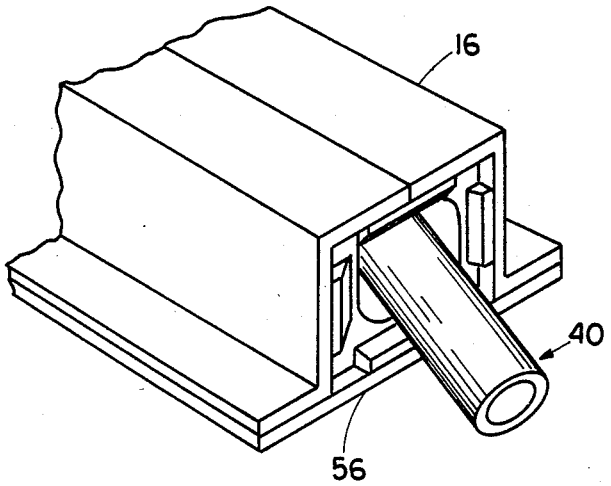
Figure 8C:
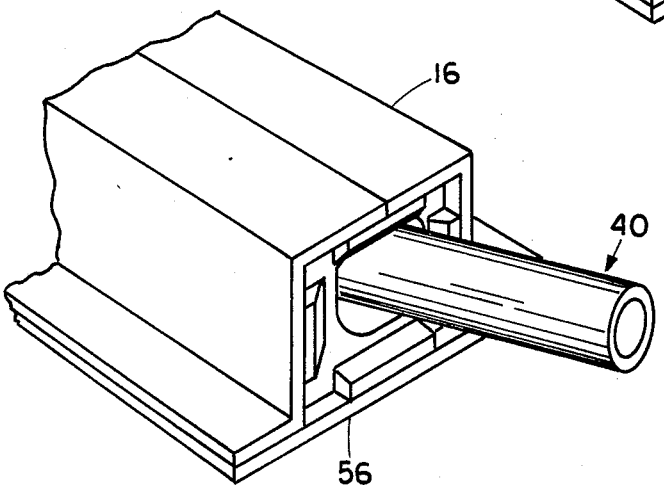

FIGS. 8A–8C illustrate various positions of the drawbar 40 while held by various parts located inside the end portion of the center sill. In FIG. 8A, the axis of the drawbar 40 is coincident with or parallel to the axis of the the center sill 16. In FIG. 8B, it is rotated with respect to the axis of the center sill 16 in a horizontal plane; whereas in FIG. 8C, it is rotated in a vertical plane relative to the axis of the sill 16. As it rotates in a horizontal plane as shown in FIG. 8B, the front draft load bearing block 52 must rotate with it. This is by virtue of the fact that the opening in the draft load bearing block is longer in the vertical direction than in the horizontal direction. Thus, during horizontal movement of the drawbar 40, draft load bearing block 52 must rotate with it; however in the case of vertical or up and down movement of the drawbar 40, draft load bearing block 52 need not rotate.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A drawbar arrangement for coupling railroad cars having a center sill and trucks at its opposite ends pivotal about vertical kingpins, said arrangement including a drawbar having a shank extending to an enlarged spherical butt end portion defining essentially convex spherical buff and draft load bearing surfaces, the shank of the drawbar projecting from said convex spherical draft load bearing surface, a rear support block having a tapered rear surface and a concave substantially hemispherical buff load bearing surface adapted to engage with the convex buff load bearing surface of said butt end portion, a slack adjusting wedge for engaging the tapered surface of said rear support block, means for transferring buff loads from said slack adjusting wedge to said center sill, a front draft block having a concave and substantially hemispherical draft load surface adapted to engage with the convex draft load surface on said butt end portion, said front draft block including an annular draft load surface opposite said hemispherical draft load surface, a wear block having an annular draft load surface adapted to engage the annular draft load surface of said front draft block, and means supported by said center sill for transferring draft load from said wear block to the center sill.

2. The drawbar arrangement according to claim 1 wherein said front draft block and said wear block each has an opening wherein the shank of said drawbar extends in a direction which is generally opposite said kingpin.

3. The drawbar arrangement according to claim 1 wherein said means supported by said center sill includes a plurality of draft stop lugs supported by said center sill.

4. The drawbar arrangement according to claim 3 further including a sill bottom plate secured to said center sill for supporting one of said plurality of draft stop lugs.

5. The drawbar arrangement according to claim 1 wherein said center sill includes spaced-apart sill side walls extending along opposite sides of a sill roof wall, said drawbar arrangement further including a carrier plate supported by said center sill opposite said roof wall for supporting said rear support block, front draft block and said wear block between the side walls of the center sill.

6. The drawbar arrangement according to claim 5 wherein the tapered surface of said slack adjusting wedge extends in a vertical direction along the height of the side walls of said center sill.

7. The drawbar arrangement according to claim 6 wherein said slack adjusting wedge has a tapered thickness which is greater at the top thereof than at the bottom for movement under the force of gravity between said rear support block and said means for transferring buff loads.

8. The drawbar arrangement according to claim 7 wherein said means for transferring buff loads include lugs projecting from the side walls of said center sill.

9. The drawbar arrangement according to claim 1 wherein said front draft block has an opening extending therethrough which is longer in one dimension than the other.

10. The drawbar arrangement according to claim 1 wherein said front draft block has an opening which is longer in the vertical direction than in the horizontal direction, whereby said draft front block will rotate with said drawbar shank portion in a horizontal plane but not in a vertical plane.

11. The drawbar arrangement according to claim 1 wherein said rear support block and said front draft block can rotate in an endless manner about an axis extending substantially along a central longitudinal axis of said shank relative to said convex spherical buff and draft load surfaces.

12. The drawbar arrangement according to claim 11 wherein said shank is annular in cross section.

* * * * *